US005102304A

United States Patent [19]

Renn

[11] Patent Number: 5,102,304

[45] Date of Patent: Apr. 7, 1992

[54] PUMP APPARATUS

[76] Inventor: Robert Renn, P.O. Box 665, Carnelian Bay, Calif. 95711

[21] Appl. No.: 636,186

[22] Filed: Dec. 31, 1990

[51] Int. Cl.[5] ..... F04B 35/06

[52] U.S. Cl. ..... 417/360; 248/79; 239/282; 222/464

[58] Field of Search ..... 417/360; 4/541, 542, 4/544; 248/79; 239/282; 227/464, 382

[56] References Cited

U.S. PATENT DOCUMENTS

| | | | |
|---|---|---|---|
| 246,849 | 9/1881 | Williams | 239/282 |
| 2,073,307 | 4/1935 | Isenberg | 239/282 |
| 2,600,478 | 6/1952 | Butcher | 248/79 |
| 3,064,340 | 11/1962 | Green | 417/360 |
| 3,470,822 | 10/1969 | Evans et al. | 417/313 |
| 4,127,117 | 11/1978 | Peterson, Jr. | 4/544 |

FOREIGN PATENT DOCUMENTS

| | | | |
|---|---|---|---|
| 328374 | 4/1958 | Switzerland | 248/79 |

*Primary Examiner*—Richard A. Bertsch
*Assistant Examiner*—Charles Freay
*Attorney, Agent, or Firm*—Leon Gilden

[57] ABSTRACT

A portable pump assembly is provided for mounting overlying a sink or shower stall to effect selective directing of water from a washing type form for subsequent use in irrigation, commodes, and the like in geographical areas of limited water availability. The apparatus includes spaced side walls mounting a pump housing thereon. The pump housing includes a threaded inlet and outlet conduit for mounting thereon. Clamp members are directed through a second side wall cooperative with a first side wall to effect securement of a flange of a sink and the like therebetween. The assembly further includes a clip member for positioning an outlet tube relative to a receiving bucket or container.

1 Claim, 6 Drawing Sheets

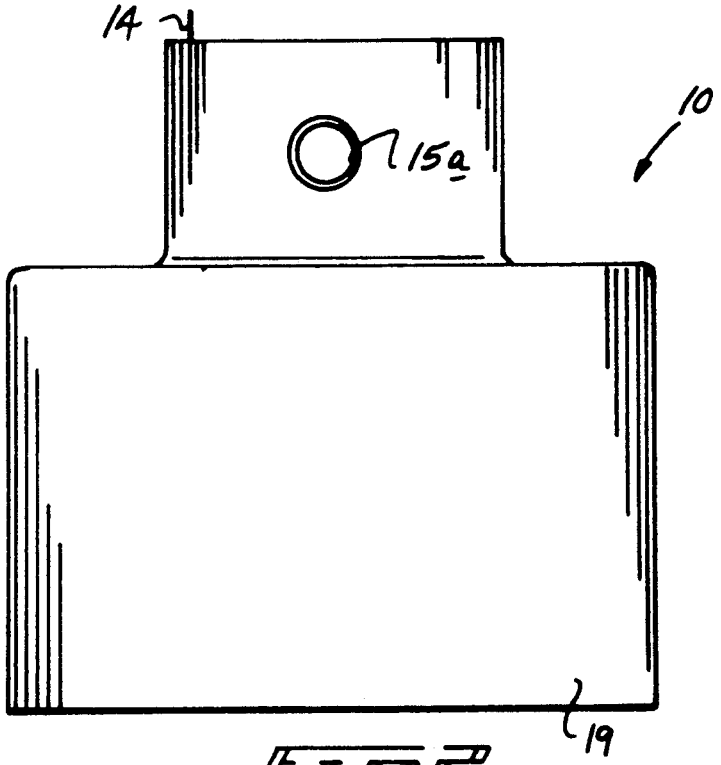
Fig 2
Fig 3
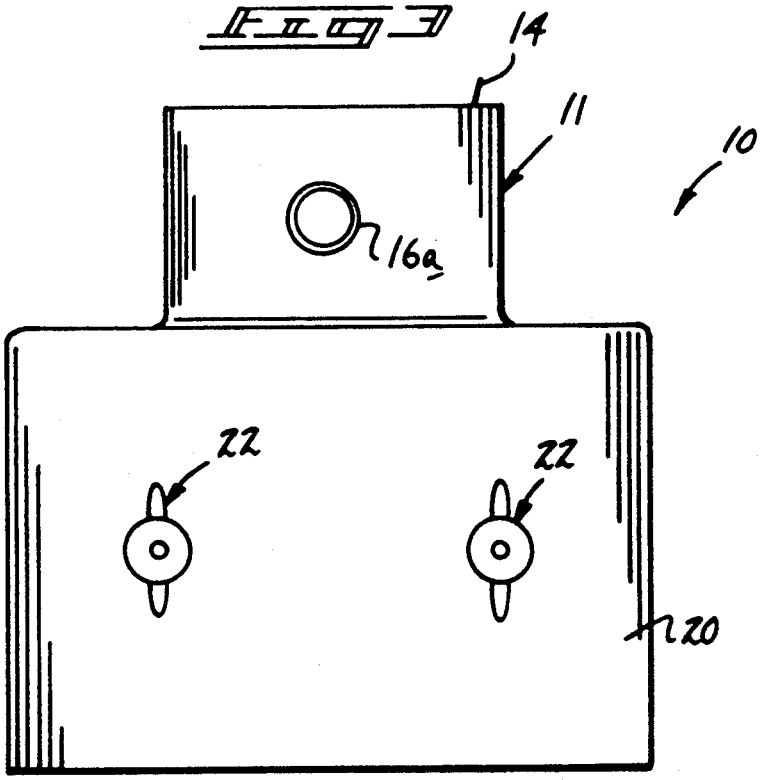

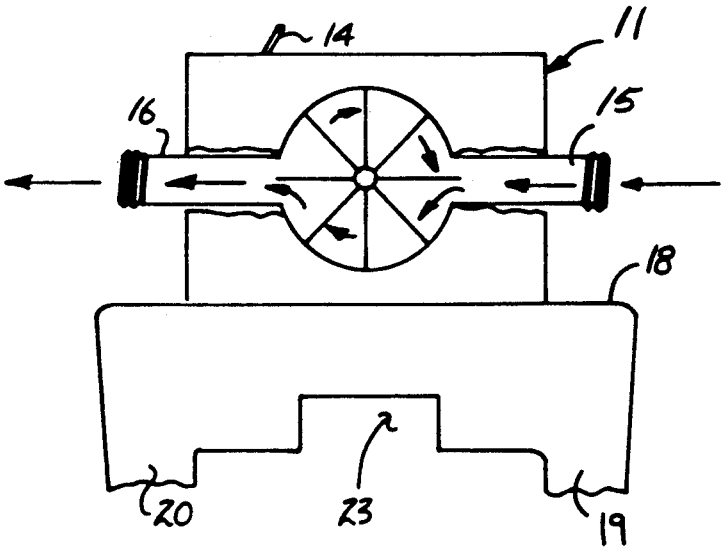
Fig 6
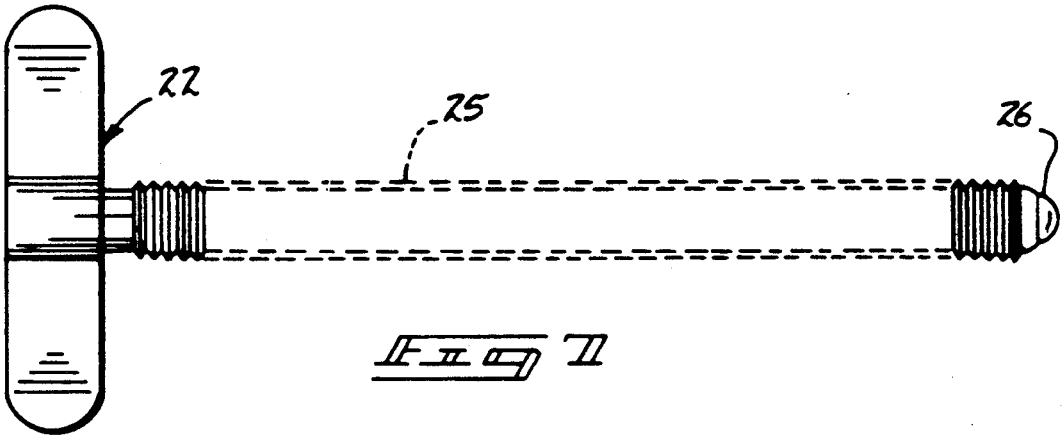
Fig 7
Fig 8
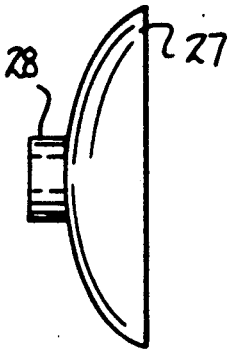

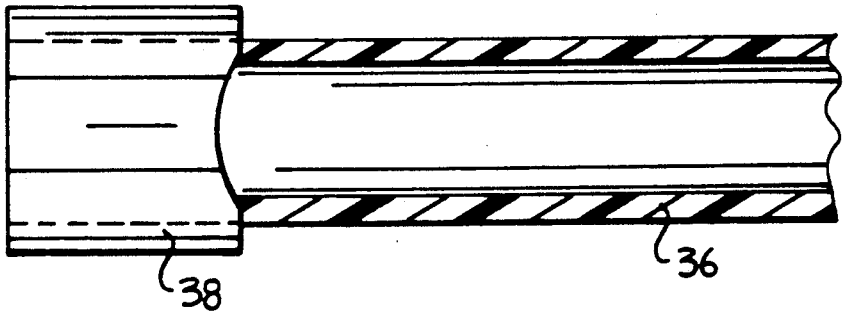
Fig 12
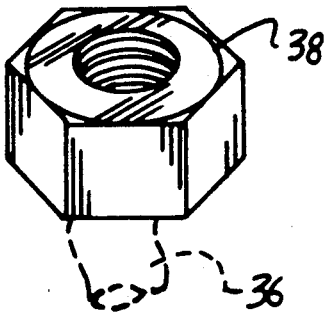
Fig 13
Fig 14
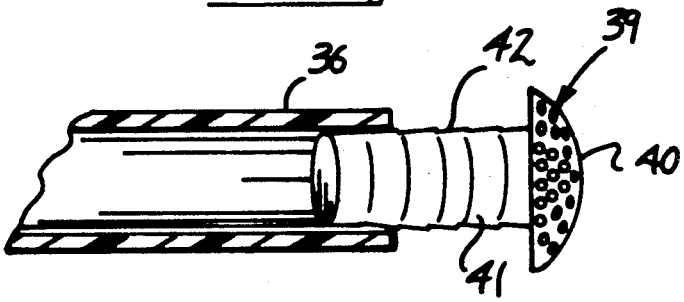

PUMP APPARATUS

BACKGROUND OF THE INVENTION

1. Field of the Invention

The field of invention relates to pump apparatus, and more particularly pertains to a new and improved pump apparatus wherein the same is arranged for portable mounting relative to a sink and the like for directing water for subsequent reuse.

2. Description of the Prior Art

In many drought sensitive areas, the reuse of water is mandated by its scarcity. The instant invention sets forth an organization readily mounted to a sink, shower stall, or the like to receive a flange of a sink or shower stall therewithin to mount a pump housing for directing water for reuse. Prior organizations have generally been of elaborate configurations not readily available for such mounting. Examples of the prior art include U.S. Pat. No. 4,467,627 to Platt, et al. setting forth a pump organization for use with an automatic washer.

U.S. Pat. No. 4,852,609 to Schoenauer sets forth a sump pump organization for permanently mounting relative to a sump area within a dwelling.

U.S. Pat. No. 4,491,150 to Holman, et al. sets forth an outdoor water holding and pumping system mounted within a housing that may be manipulated relative to various locations.

U.S. Pat. No. 4,798,522 to Kaga, et al. sets forth a pump and fluid supply organization for use in directing fuel such as in a self-propelled vehicle.

U.S. Pat. No. 4,306,844 to Otto, et al. sets forth a fluid pump for use in mounting within a fuel tank of a vehicle.

As such, it may be appreciated that there continues to be a need for a new and improved pump apparatus as set forth by the instant invention which addresses both the problems of ease of use as well as effectiveness in construction in its mounting to a sink structure and the like and in this respect, the present invention substantially fulfills this need.

SUMMARY OF THE INVENTION

In view of the foregoing disadvantages inherent in the known types of pump apparatus now present in the prior art, the present invention provides a pump apparatus wherein the same is readily secured and mounted as required to an associated sink or shower stall to direct water therefrom permitting its reuse. As such, the general purpose of the present invention, which will be described subsequently in greater detail, is to provide a new and improved pump apparatus which has all the advantages of the prior art pump apparatus and none of the disadvantages.

To attain this, the present invention provides a portable pump assembly for mounting overlying a sink or shower stall to effect selective directing of water from a washing type form for subsequent use in irrigation, commodes, and the like in geographical areas of limited water availability. The apparatus includes spaced side walls mounting a pump housing thereon. The pump housing includes a threaded inlet and outlet conduit for mounting thereon. Clamp members are directed through a second side wall cooperative with a first side wall to effect securement of a flange of a sink and the like therebetween. The assembly further includes a clip member for positioning an outlet tube relative to a receiving bucket or container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pump apparatus which has all the advantages of the prior art pump apparatus and none of the disadvantages.

It is another object of the present invention to provide a new and improved pump apparatus which may be easily and efficiently manufactured and marketed.

It is a further object of the present invention to provide a new and improved pump apparatus which is of a durable and reliable construction.

An even further object of the present invention is to provide a new and improved pump apparatus which is susceptible of a low cost of manufacture with regard to both materials and labor, and which accordingly is then susceptible of low prices of sale to the consuming public, thereby making such pump apparatus economically available to the buying public.

Still yet another object of the present invention is to provide a new and improved pump apparatus which provides in the apparatuses and methods of the prior art some of the advantages thereof, while simultaneously overcoming some of the disadvantages normally associated therewith.

Still another object of the present invention is to provide a new and improved pump apparatus wherein the same permits its mounting relative to a sink organization or the like to secure the pump apparatus relative to waste water permitting its reuse.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic right side view of the instant invention.

FIG. 3 is an orthographic left side view of the instant invention.

FIG. 6 is a diagrammatic illustration illustrating the use of a centrifugal pump in association with the unit conduits of the instant invention.

FIG. 7 is an orthographic view of one of a plurality of clamps utilized by the instant invention.

FIG. 8 is an orthographic side view, taken in elevation, of a mounting cup member utilized by the instant invention in association with each clamp.

FIG. 12 is an orthographic side view, partially in section, of one of a plurality of fluid hoses utilized by the instant invention.

FIG. 13 is an isometric illustration of the internally connected threaded utilized by each fluid hose.

FIG. 14 is an isometric illustration, partially in section of the entrance fluid hose in association with a filter head.

DESCRIPTION OF THE PREFERRED EMBODIMENT

Figure 1:
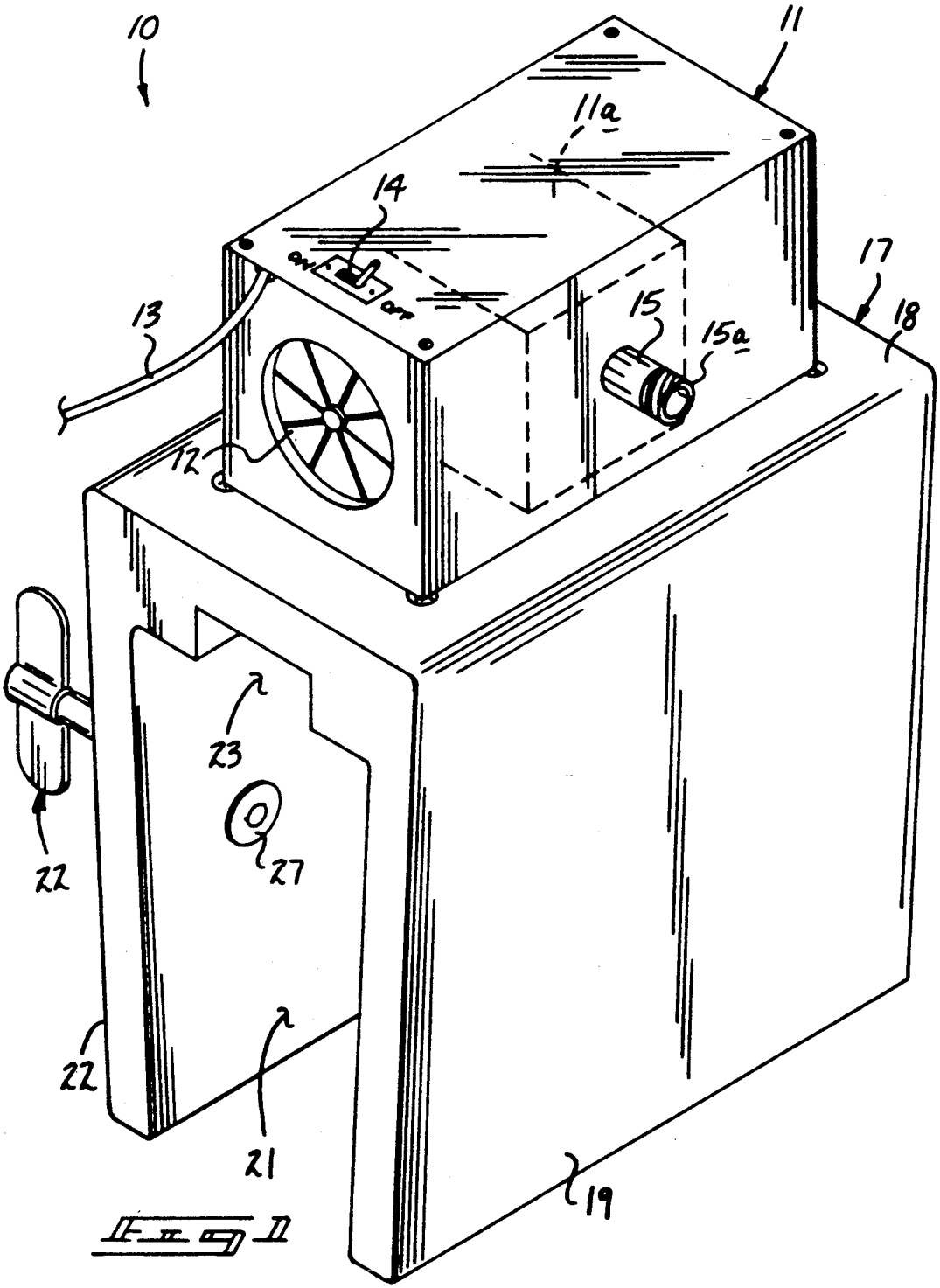
FIG. 1 is an isometric illustration of the invention defined by a pump housing and associated support housing.

With reference now to the drawings, and in particular to FIGS. 1 to 14 thereof, a new and improved pump apparatus embodying the principles and concepts of the present invention and generally designated by the reference numerals 10–42 will be described.

More specifically, the pump apparatus of the instant invention essentially comprises a pump housing 11 fixedly mounted to a top wall 18 of an underlying support housing 17. The pump housing 11 mounts a centrifugal pump 11*a* therewithin, with a drive motor 12 driving the centrifugal pump 11*a* utilizing electrical power cord 13 and operative through an on/off switch 14. An inlet conduit 15 is mounted to a first side wall of the pump housing 11, with an outlet conduit 16 mounted on an opposed side wall. Each respective inlet and outlet conduit includes a respective externally threaded end 15*a* and 16*a*. The support housing 17 includes a first side wall 19 spaced from a second side wall 20. The first side wall 19 includes a lower terminal end 19*a*, the second side wall including a second side wall lower terminal end 20*a*. The first and second side walls define a mounting slot 21 therebetween to permit mounting of the support housing 17 onto a flange of a sink member and the like. It is noted that a secondary mounting slot 23 is directed through a bottom surface of the top wall 18 to permit alignment of the interior surface of the top wall 18 onto a narrower sink flange or to overlie a shower stall flange, as required, to permit portability and positioning of the apparatus as required. The first and second side walls 19 and 20 include respective first and second lower terminal end 19*a* and 20*a* that are spaced apart a first spacing defining a narrowed entrance 24 (se FIG. 4), wherein the first spacing is less than that of the second spacing defined between upper terminal ends of the first and second side walls 19 and 20.

Spaced clamps 22 are orthogonally directed through and threadedly received within threaded side wall apertures 22*a*, wherein each of the spaced clamps 22 included a threaded shank 25 (see FIG. 7) and terminates in a spherical tip 26 to mount a resilient cup member 27 within a socket housing 28 of each cup member to permit pivotment of each cup member 27 relative to the surface of a flange to accommodate various geometrical variations thereof.

Figure 4:
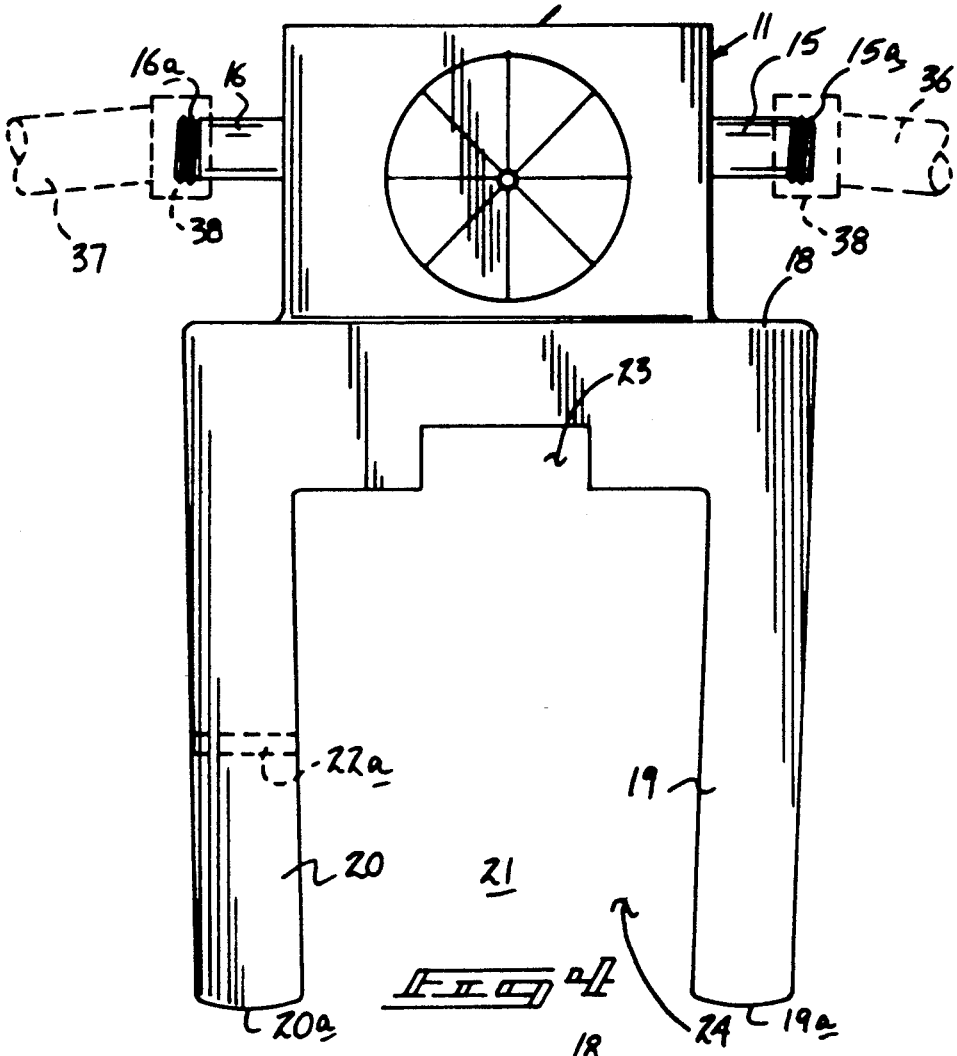
FIG. 4 is an orthographic end view, taken in elevation, of the instant invention.
Figure 5:
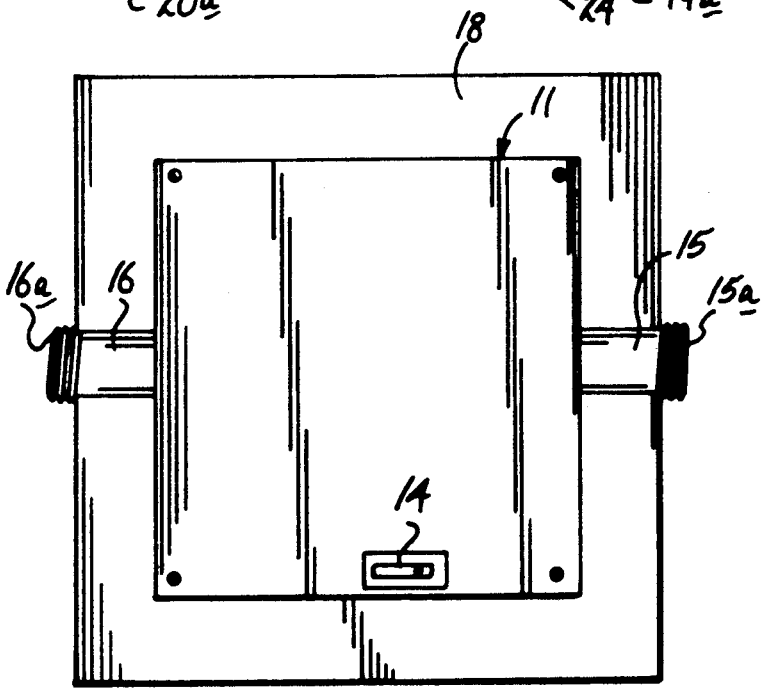
FIG. 5 is an orthographic top view of the instant invention.
Figure 9:
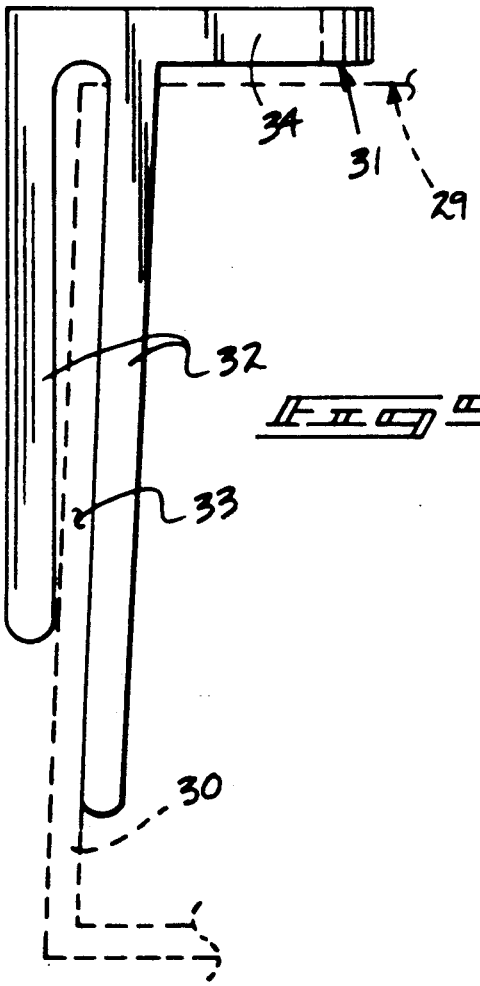
FIG. 9 is an orthographic side view, taken in elevation, of a clip member utilized for mounting to a transportable bucket for mounting to a transportable bucket.
Figure 10:
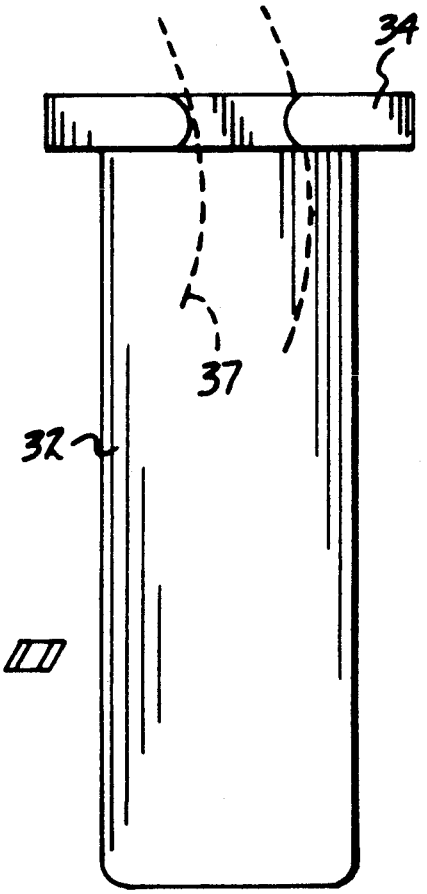
FIG. 10 is an orthographic frontal view, taken in elevation, of the clip member, as illustrated in FIG. 9.
Figure 11:
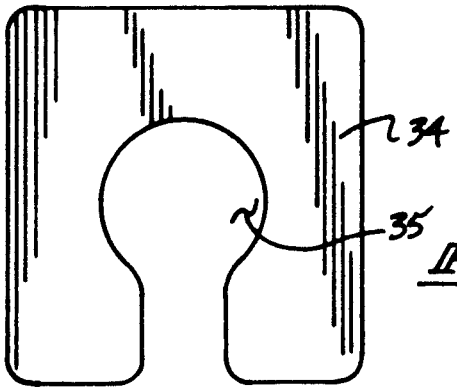
FIG. 11 is an orthographic top view of the clip member as illustrated in FIG. 9.

Reference to FIGS. 9–11 illustrate the use of a clip member 31 for mounting to a bucket member 29, and more specifically to a bucket member side wall 30 of the bucket member 29. Bifurcated legs 32 of the clip member define a bucket receiving slot therebetween, wherein the legs are resiliently biased towards one another to effect engagement of the bucket side wall between the bifurcated legs. A clip member head 34 is orthogonally and fixedly mounted to upper terminal ends of the bifurcated legs 32 and extend laterally of the bifurcated legs, with the clip member head 34 defining a keyhole slot 35 to receive and secure a fluid entrance hose 36 within the slot. Reference to FIG. 4 illustrates the use of a fluid entrance hose 36 mounted to the inlet conduit 15, with a fluid exit hose 37 mounted to the fluid outlet conduit 16. Each hose includes an internally threaded connector 38 and in turn is mounted to each respective externally threaded end of the inlet and outlet conduit 15*a* and 16*a* respectively. The internally threaded connector 38 permits mounting of each hose thereto in a convenient and secure manner. FIG. 14 illustrates the use of a filter head 39 that is secured within an entrance opening of the entrance hose 36. The filter head 39 includes a semi-spherical apertured head 40 in fluid communication with a filter tube 41. The filter tube 41 includes a serrated exterior surface 42 to provide frictional engagement within an internal surface of the entrance hose 36. In this manner, the filter head 39 is directed within water to be removed from within a sink or shower organization and permits directing of fluid exteriorly therefrom to be received within a convenient receptacle such as the bucket member 30, with the exit hose 37 mounted within the keyhole slot 35.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pump apparatus comprising, in combination, a pump housing, the pump housing including a pump member mounted therewithin, and an inlet conduit directed through a first side wall of the pump housing in fluid communication with the pump member, and an outlet conduit directed through a second side wall of the pump housing in fluid communication with the pump member, and drive means for effecting selective actuation of the pump member, and a support housing, the support housing including a top wall, with the pump housing fixedly mounted to a top surface of the top wall, and the support housing further including a first side wall spaced from a second side wall defining a mounting slot therebetween, and clamp means directed through the second side wall to secure a flange therewithin, and wherein the clamp means includes a plurality of spaced clamps, each of the spaced clamps including a threaded shank, each threaded shank threadedly received within a threaded aperture orthogonally directed through the second side wall, and each threaded shank including a spherical tip projecting within the mounting slot, and each spherical tip including a resilient cup member mounted thereon, with each resilient cup member including a socket housing, with each socket housing pivotally mounting the spherical tip therewithin, and wherein the top wall of the support housing includes a secondary mounting slot coextensive with a bottom surface of the top wall overlying the mounting slot, with the secondary mounting slot defined by a second width, and the mounting slot defined by a first width, wherein the first width is greater than the second width, and the first side wall includes a first side wall lower terminal end and a second side wall includes a second side wall lower terminal end, with the first side wall lower terminal end spaced from the second side wall lower terminal end a first spacing, and a first side wall upper terminal end spaced from a second side wall upper terminal end a second spacing wherein the first spacing is less than the second spacing to enhance engagement of a flange between the first side wall and the second side wall, and wherein the inlet conduit includes an inlet conduit externally threaded end and the outlet conduit includes an outlet conduit externally threaded end, and the inlet conduit externally threaded end mounting a first internally threaded connector, and the outlet conduit externally threaded end mounting a second internally threaded connector, the first internally threaded connector including a fluid entrance hose secured thereto, and the second internally threaded connector including a fluid exit hose fixedly secured thereto, and a bucket member, and the bucket member including a clip member mounted thereon, the clip member including a plurality of bifurcated legs forming a slot therebetween, and the clip member further including a clip mounting head orthogonally and fixedly mounted to an upper terminal end of the bifurcated legs and extending laterally thereof, and the clip member head including a key hole slot directed therethrough, and the key hole slot arranged for frictionally receiving the fluid exit hose, and wherein the fluid entrance hose includes a filter head mounted therewithin, the filter head including a semi-spherical apertured head, and the semi-spherical apertured head in fluid communication with a filter tube mounted to the apertured head, and the filter tube including a serrated external surface for frictionally securing the filter tube within the fluid entrance hose.

* * * * *